US008015769B2

(12) United States Patent
Crostic, Jr. et al.

(10) Patent No.: US 8,015,769 B2
(45) Date of Patent: Sep. 13, 2011

(54) CONNECTOR FOR SECURING METAL ROOFING COMPONENTS, METAL ROOF ASSEMBLY, AND METHOD OF INSTALLING A METAL ROOF

(75) Inventors: William H. Crostic, Jr., Simpsonville, SC (US); Lawrence Zupon, Bentleyville, OH (US)

(73) Assignee: Guardian Building Products, Inc., Greer, SC (US)

( * ) Notice: Subject to any disclaimer, the term of this patent is extended or adjusted under 35 U.S.C. 154(b) by 86 days.

(21) Appl. No.: 12/565,216

(22) Filed: Sep. 23, 2009

(65) Prior Publication Data

US 2011/0067345 A1 Mar. 24, 2011

(51) Int. Cl.
*E04B 1/74* (2006.01)

(52) U.S. Cl. ..... 52/407.4; 52/404.3; 52/745.06; 52/745.21; 52/90.1; 52/712; 24/198

(58) Field of Classification Search ..... 52/698, 52/699, 285.1, 704, 709–713, 745.21, 745.06, 52/90.1, 404.3, 407.4, 650.3, 665; 24/198, 24/265 CD, 545, 570
See application file for complete search history.

(56) References Cited

U.S. PATENT DOCUMENTS

| | | | | |
|---|---|---|---|---|
| 341,127 | A * | 5/1886 | Bertzfield | 24/198 |
| 896,646 | A | 8/1908 | Litsch | |
| 1,423,991 | A * | 7/1922 | Brooks | 52/370 |
| 1,675,040 | A * | 6/1928 | Mix | 24/198 |
| 2,058,148 | A * | 10/1936 | Hard | 52/714 |
| 2,177,187 | A | 10/1939 | Olsen | |
| 2,213,924 | A * | 9/1940 | Tinnerman | 403/21 |
| 2,339,841 | A * | 1/1944 | Deuchler et al. | 52/489.2 |
| 3,341,994 | A * | 9/1967 | Olson | 52/473 |
| 3,618,993 | A * | 11/1971 | Platte | 52/713 |
| 3,693,312 | A * | 9/1972 | Miller | 52/699 |

(Continued)

FOREIGN PATENT DOCUMENTS

EP 173437 A1 * 3/1986

(Continued)

OTHER PUBLICATIONS

Fall Protection in Construction, U.S. Department of Labor, Occupational Safety and Health Administration, OSHA 33146, 1998 (Revised).

(Continued)

*Primary Examiner* — Robert J Canfield
*Assistant Examiner* — Babajide Demuren
(74) *Attorney, Agent, or Firm* — Dority & Manning, P.A.

(57) ABSTRACT

A connector for securing a roofing band to a roofing beam by a threaded fastener may include a circumferential flange portion, first and second recess extending within the circumferential flange portion sized to accept a roofing band, and a central portion extending within the circumferential flange portion between the first recess and the second recess, a middle area of the central portion being offset laterally from the circumferential flange portion by a distance enough to permit the roofing band to be slid through the first and second recesses so that the circumferential flange portion is located on a first side of the roofing band and the middle area of the central portion is located on a second side of the roofing band opposite the first side. A single fastener opening defined through the central portion, the fastener opening sized for receiving a threaded fastener therethrough for fastening the roofing band to a roofing beam. Related roofing assemblies and methods of construction are disclosed.

18 Claims, 7 Drawing Sheets

U.S. PATENT DOCUMENTS

| | | | | | |
|---|---|---|---|---|---|
| 3,845,602 | A | * | 11/1974 | Alderman | 52/745.06 |
| 3,869,763 | A | * | 3/1975 | Senk et al. | 24/198 |
| 3,950,904 | A | * | 4/1976 | Littman | 52/105 |
| 3,969,863 | A | | 7/1976 | Alderman | |
| 4,011,639 | A | | 3/1977 | Koleske | |
| 4,047,345 | A | * | 9/1977 | Alderman | 52/404.1 |
| 4,047,346 | A | | 9/1977 | Alderman | |
| 4,069,636 | A | | 1/1978 | Kessler | |
| 4,075,806 | A | | 2/1978 | Alderman | |
| 4,075,807 | A | | 2/1978 | Alderman | |
| 4,147,003 | A | * | 4/1979 | Alderman | 52/309.8 |
| 4,150,465 | A | | 4/1979 | Gavin, Jr. | |
| 4,172,345 | A | | 10/1979 | Alderman | |
| 4,318,260 | A | | 3/1982 | Siegel et al. | |
| 4,446,664 | A | * | 5/1984 | Harkins | 52/404.3 |
| 4,449,343 | A | | 5/1984 | Henningsen | |
| 4,573,298 | A | * | 3/1986 | Harkins | 52/404.3 |
| 4,598,518 | A | * | 7/1986 | Hohmann | 52/410 |
| 4,649,689 | A | | 3/1987 | Everman et al. | |
| 4,655,913 | A | * | 4/1987 | Boersma | 210/163 |
| 4,688,739 | A | | 8/1987 | Moore | |
| 4,724,651 | A | | 2/1988 | Fligg | |
| 4,800,698 | A | | 1/1989 | Murphy | |
| 4,875,320 | A | * | 10/1989 | Sparkes | 52/406.1 |
| 4,884,932 | A | | 12/1989 | Meyer | |
| 5,004,100 | A | | 4/1991 | Smith | |
| 5,085,023 | A | | 2/1992 | Duffy | |
| 5,119,612 | A | | 6/1992 | Taylor et al. | |
| 5,307,603 | A | * | 5/1994 | Chiodo | 52/698 |
| 5,406,764 | A | * | 4/1995 | Van Auken et al. | 52/408 |
| 5,442,890 | A | | 8/1995 | Fligg | |
| 5,561,959 | A | | 10/1996 | Alderman et al. | |
| 5,581,966 | A | | 12/1996 | Fligg | |
| 5,901,518 | A | | 5/1999 | Harkins | |
| 5,953,875 | A | | 9/1999 | Harkins | |
| 6,247,288 | B1 | | 6/2001 | Harkins | |
| 6,282,857 | B1 | | 9/2001 | Rubenacker | |
| 6,308,489 | B1 | | 10/2001 | Romes | |
| 6,393,797 | B1 | | 5/2002 | Romes | |
| 6,715,256 | B1 | | 4/2004 | Fischer | |
| D497,102 | S | | 10/2004 | Kuhn | |
| D576,473 | S | * | 9/2008 | Cresswell | D8/354 |
| D625,581 | S | * | 10/2010 | Crostic et al. | D8/356 |

FOREIGN PATENT DOCUMENTS

| | | | | |
|---|---|---|---|---|
| JP | 04339964 | A | * | 11/1992 |

OTHER PUBLICATIONS

Safety Standards for Fall Protection in the Construction Industry, OSHA 29 CFR Parts 1910 and 1926, FR Doc. 94-19000, Filed Aug. 4, 1994.

Purlin Glide FP Product Brochure, Guardian Building Products, 2003.

GBP Silvercote Product Brochure, Guardian Building Products, Mar. 2007.

Energy Saver System Product Brochure, Guardian Building Products, 2006.

* cited by examiner

CONNECTOR FOR SECURING METAL ROOFING COMPONENTS, METAL ROOF ASSEMBLY, AND METHOD OF INSTALLING A METAL ROOF

BACKGROUND

Various roofing systems have been proposed for metal frame buildings. Generally, these systems include metal beams such as rafters, struts, and purlins arranged to cover the desired building interior space. The roof may also include metal support bands and sheeting along the rafters, struts, and/or purlins. The bands and sheeting provide support for additional materials such as insulation layers that may be placed atop the sheeting. An outer roof layer is placed atop the rafters, struts, and purlins to complete the roof.

In the mid 1990's, OSHA instituted fall prevention regulations. Those regulations may in some cases impact the construction of metal frame buildings. Accordingly, protective netting, harnesses, and edge protection have been employed during such construction. Also, metal support bands underlying the sheeting and insulation have been designed so as to be able to support a person who might fall into the sheeting during construction.

In particular, title 29 C.F.R. §1926.502 requires that a roof's insulation support and fall protection system restrain and support 400 pounds dropped from at least 42 inches above the system. This standard is intended to represent potential impact of a person falling onto the structure. Energy Saver FP™ roofing systems available from Guardian Building Products incorporate structures such as bands and sheeting designed to meet such requirements. Metal roofing systems available from other sources also claim to meet such requirements. One such system requires multiple fasteners be driven through both ends of longitudinal and transverse metal support bands where attached to rafters or struts, with the fasteners being spaced at least two inches from the ends of the bands.

SUMMARY

Objects and advantages of the invention will be set forth in part in the following description, or may be obvious from the description, or may be learned through practice of the invention.

In accordance with one embodiment of the present disclosure, a connector is disclosed for securing a roofing band to a roofing beam by a threaded fastener, the connector includes, for example, a circumferential flange portion, a first recess extending within the circumferential flange portion, and a second recess extending within the circumferential flange portion substantially parallel to the first recess. The first and second recesses have a length longer than a width of a roofing band. A central portion extends within the circumferential flange portion between the first recess and the second recess, a middle area of the central portion being offset laterally from the circumferential flange portion by a distance enough to permit the roofing band to be slid through the first and second recesses so that the circumferential flange portion is located on a first side of the roofing band and the middle area of the central portion is located on a second side of the roofing band opposite the first side. A single fastener opening is defined through the central portion, the fastener opening sized for receiving a threaded fastener therethrough for fastening the roofing band to a roofing beam. Various options and modifications are possible.

In yet another embodiment of the present disclosure, a metal roof assembly is disclosed including, for example, a roofing beam, a roofing band secured to an underside of the roofing beam, and a connector securing the roofing band to the roofing beam, the connector having a circumferential flange portion, a first recess extending within the circumferential flange portion, and a second recess extending within the circumferential flange portion substantially parallel to the first recess, the first and second recesses having a length longer than a width of the roofing band. A central portion extends within the circumferential flange portion between the first recess and the second recess, a middle area of the central portion being offset laterally from the circumferential flange portion. A portion of the roofing band is disposed through the first and second recesses so that the circumferential flange portion is located on a first side of the roofing band facing the roofing beam and the middle area of the central portion is located on a second side of the roofing band opposite the first side. A single fastener opening is defined through the central portion. A threaded fastener extends through the fastener opening, the roofing band, and into the roofing beam to fasten the roofing band to a roofing beam. Again, various options and modifications are possible.

In still another embodiment of the present disclosure, a method is disclosed for installing a metal roof, the method including, for example, constructing a roof frame of metal beams, attaching a grid of roof bands to the metal beams using threaded fasteners and connectors, each connector having a circumferential flange portion, a first recess extending within the circumferential flange portion, and a second recess extending within the circumferential flange portion substantially parallel to the first recess, the first and second recesses having a length longer than a width of one of the roofing bands. A central portion extends within the circumferential flange portion between the first recess and the second recess, a middle area of the central portion being offset laterally from the circumferential flange portion. The attaching step includes sliding the connector onto the roofing band so that a portion of the roofing band is disposed through the first and second recesses so that the circumferential flange portion is located on a first side of the roofing band facing the roofing beam and the middle area of the central portion is located on a second side of the roofing band opposite the first side, a single fastener opening defined through the central portion. The attaching step further includes inserting a threaded fastener through the fastener opening, the roofing band, and into the roofing beam to fasten the roofing band to a roofing beam. As above, various options and modifications are possible.

Other features and aspects of the present disclosure are discussed in greater detail below.

BRIEF DESCRIPTION OF THE DRAWINGS

A full and enabling disclosure, including the best mode thereof, directed to one of ordinary skill in the art, is set forth more particularly in the remainder of the specification, which makes reference to the appended figure in which.

Figure 1:
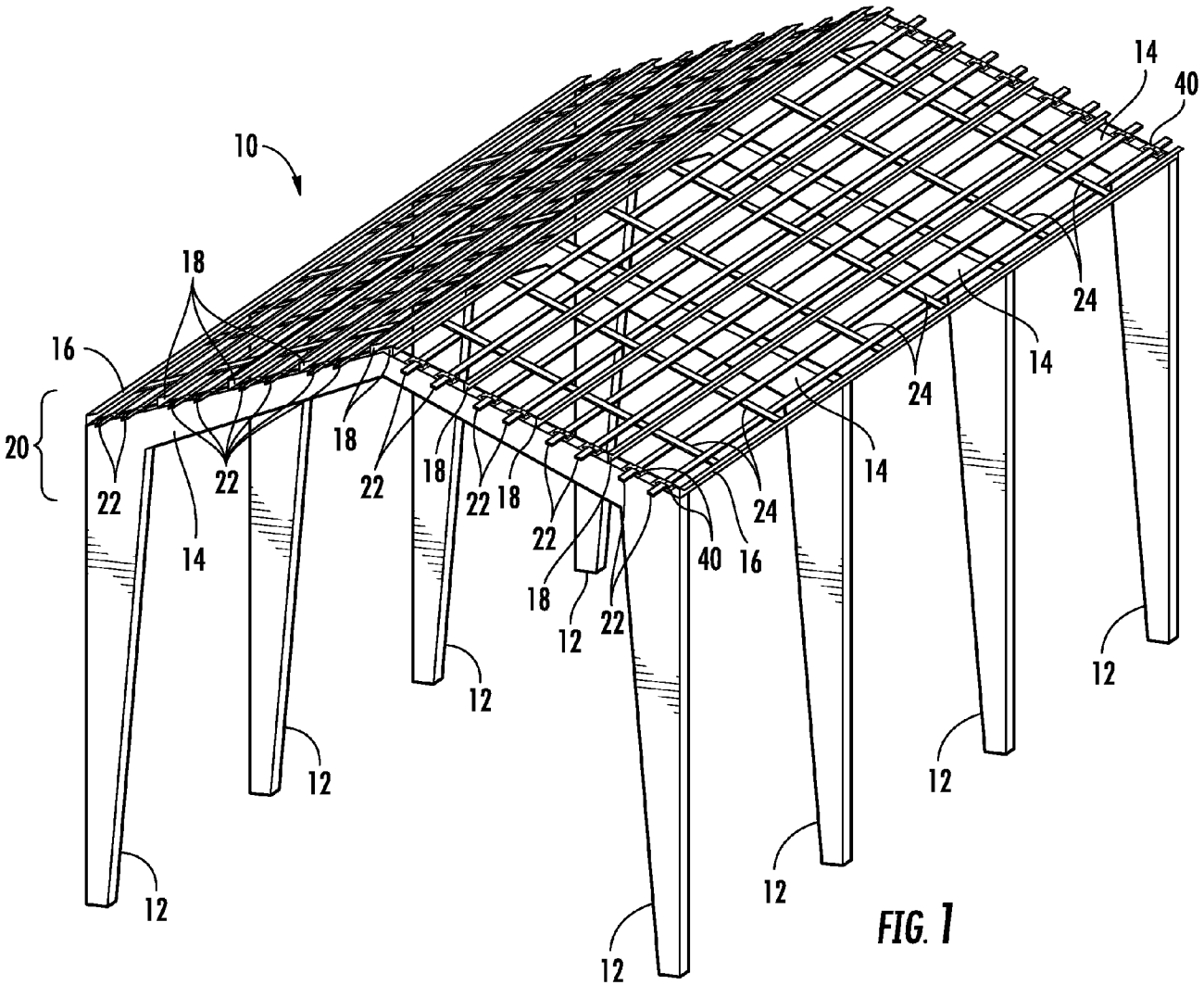
FIG. 1 is a perspective view of a structure including portions of a metal roof assembly according to the present disclosure.

Repeat use of reference characters in the present specification and drawings is intended to represent same or analogous features or elements of the disclosure.

DETAILED DESCRIPTION

Reference now will be made in detail to various embodiments of the disclosure, one or more examples of which are set forth below. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment, can be used on another embodiment to yield a still further embodiment. Thus, it is intended that the present disclosure covers such modifications and variations as come within the scope of the appended claims and their equivalents.

The present disclosure is generally directed to connectors, building assemblies, and methods useful in constructing metal buildings. Use of the connectors, structures and methods disclosed herein provide a safe, efficient, and advantageous design and building process.

Referring to FIG. 1, a partial view of a metal building 10 is shown. Building 10 includes beams such as upright columns 12, rafters 14, struts 16, and purlins 18. It should be understood that the present disclosure is not limited to any particular metal building or roofing configuration. As shown, columns 12 and rafters 14 are integral. However, these parts could be separate parts connected together, as in known designs. Further various types of metal beams, and various shapes of beams such as rafters, struts, and purlins are also capable of being employed with the present disclosure. No limitation as to any of the above is intended by this disclosure.

As shown, roof portion 20 of building 10 includes struts 16 and purlins 18 mounted atop rafters 14. Criss-crossing metal bands 22, 24 are attached to a bottom surfaces of struts 16 and purlins 18, and well as a top surface of the rafters 14 on ends of building 10 (i.e., the end rafters).

Figure 2:
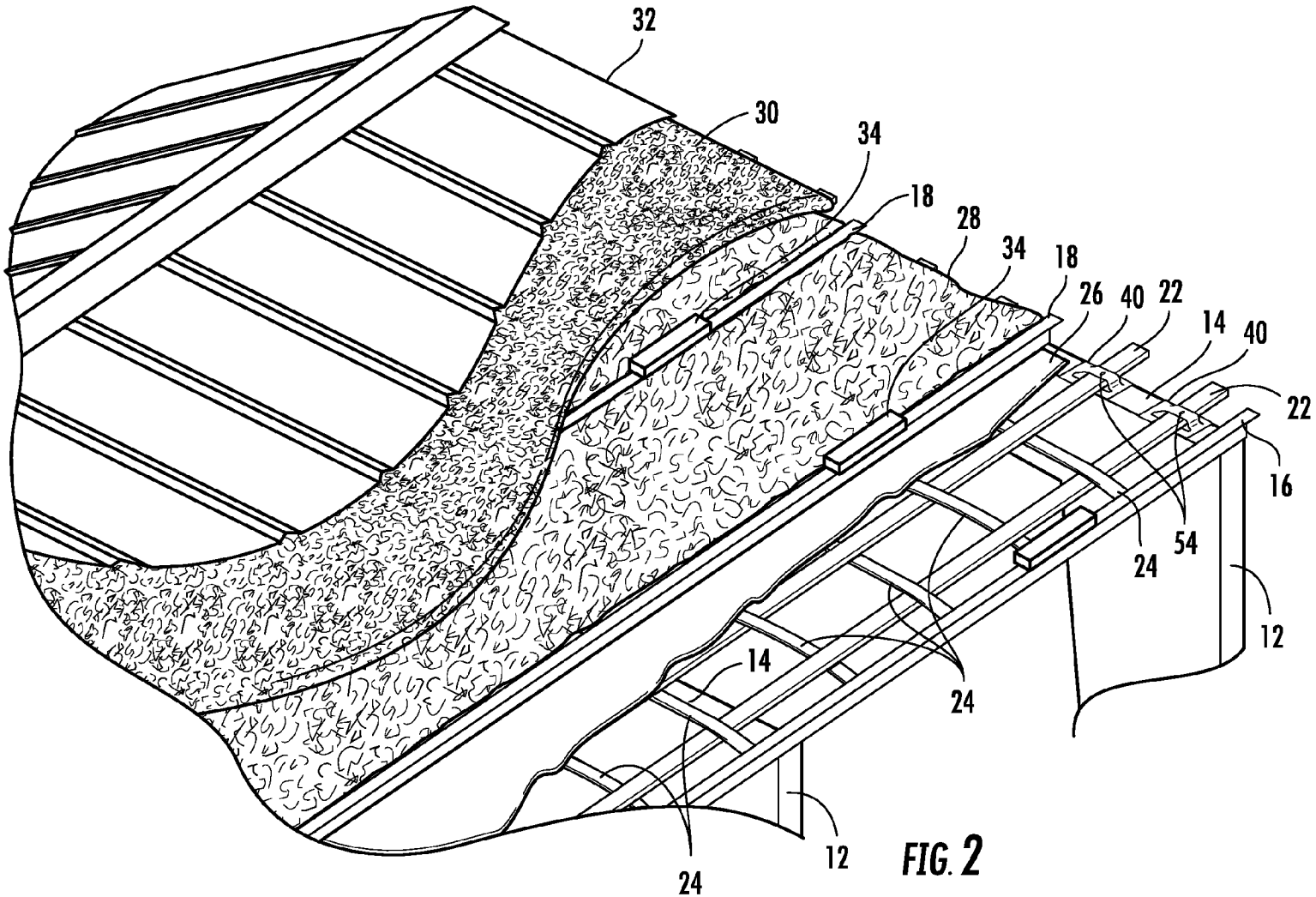
FIG. 2 is a perspective partial view of a metal roof assembly according to the present disclosure showing various layers atop the metal structure.
Figure 3:
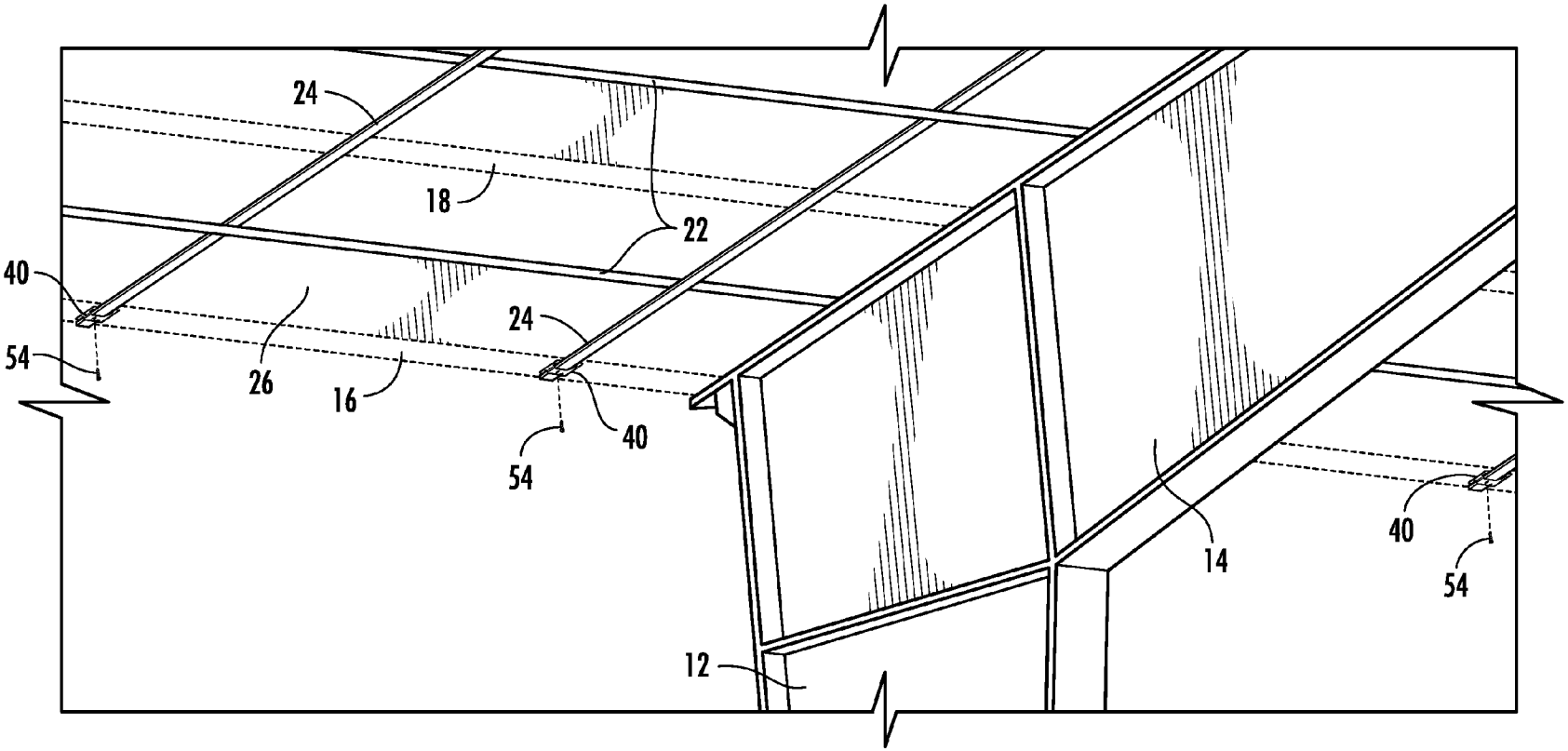
FIG. 3 is a bottom perspective partial view of a metal roof assembly according to the present disclosure.
Figure 4:
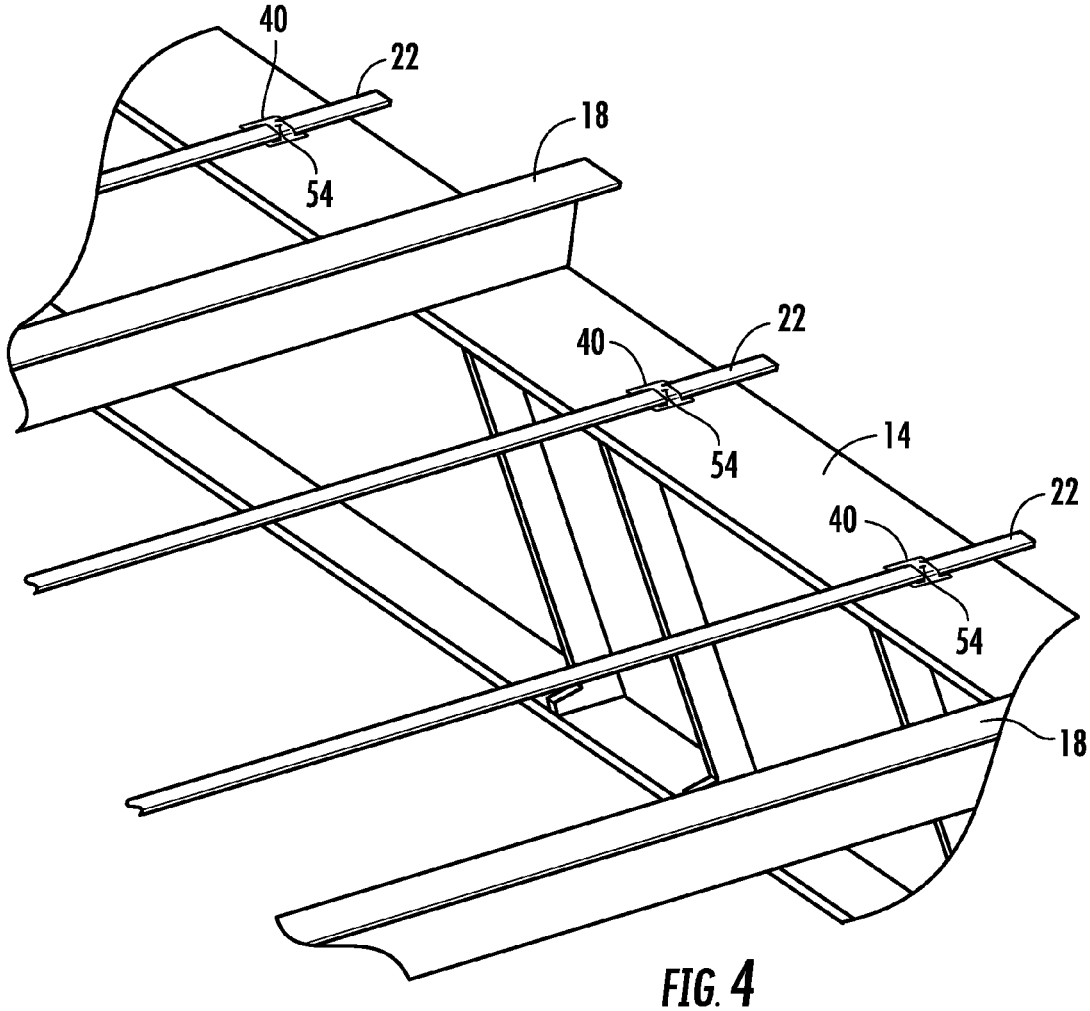
FIG. 4 is a top perspective partial view of metal roof assembly according to the present disclosure.

Bands 22, 24 may be made of steel. If desired, the steel may be galvanized and painted white for aesthetics. The bands may be Energy Saver FP™ banding available from Guardian Building Products. Sheeting material 26 is installed above bands 22, 24 and rafters 14 but below the struts 16 and purlins 18 (See FIGS. 2 and 3). Sheeting 26 can be notched, installed in sections, etc. to ensure coverage of the entire roof area. Edges of sheeting 26 can be glued in place to maintain a smooth and environmentally tight structure. If desired the sheeting material may be Energy Saver FP™ fabric available from Guardian Building Products. Such fabric provides fall protection, strength, condensation control, fire and smoke retardation and other benefits.

At least one insulation layer is typically located atop sheeting 26. As shown, a first insulation layer 28 is laid parallel to and substantially between purlins 18, and a second insulation layer 30 is laid perpendicularly across the first insulation layer. Outer roofing material 32, which can be for example formed metal panels or the like, is then attached to purlins 18. If desired, second layer 30 could be omitted and spacers 34 could be attached to a top surface of purlins 18 for attachment of outer roofing material 32 with reduced heat transfer. Such spacers or other alternate attachment elements could also be used with the double layer insulation structure if desired. If desired in a particular application, the insulation layers could be omitted, although such is not generally recommended for best performance.

Figure 5:
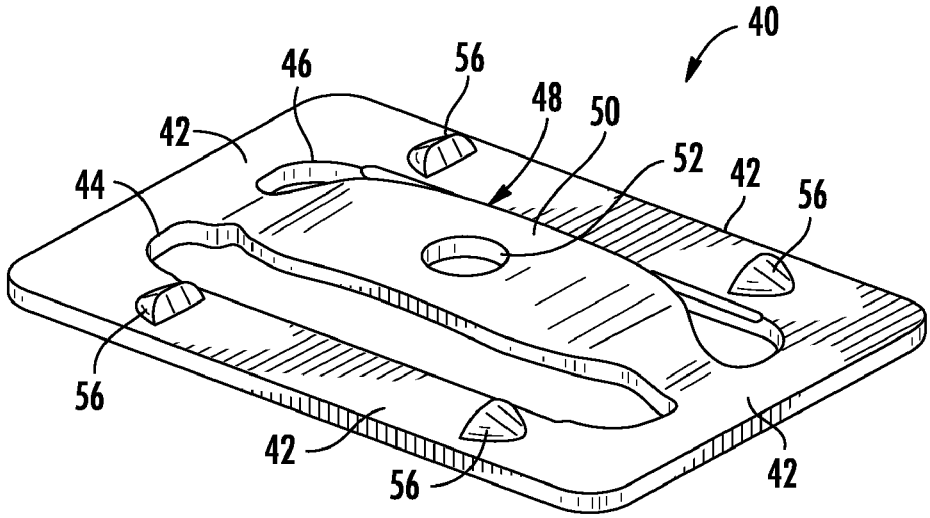
FIG. 5 is a perspective view of a metal roof assembly according to the present disclosure.
Figure 6:
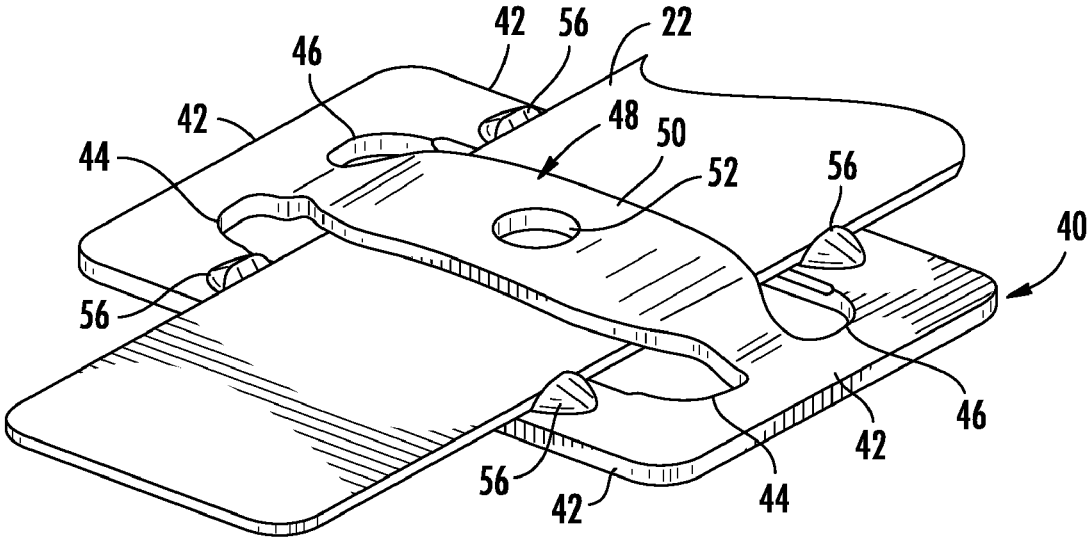
FIG. 6 is a perspective view of a connector as in FIG. 5, with a roofing band inserted therein.
Figure 7:
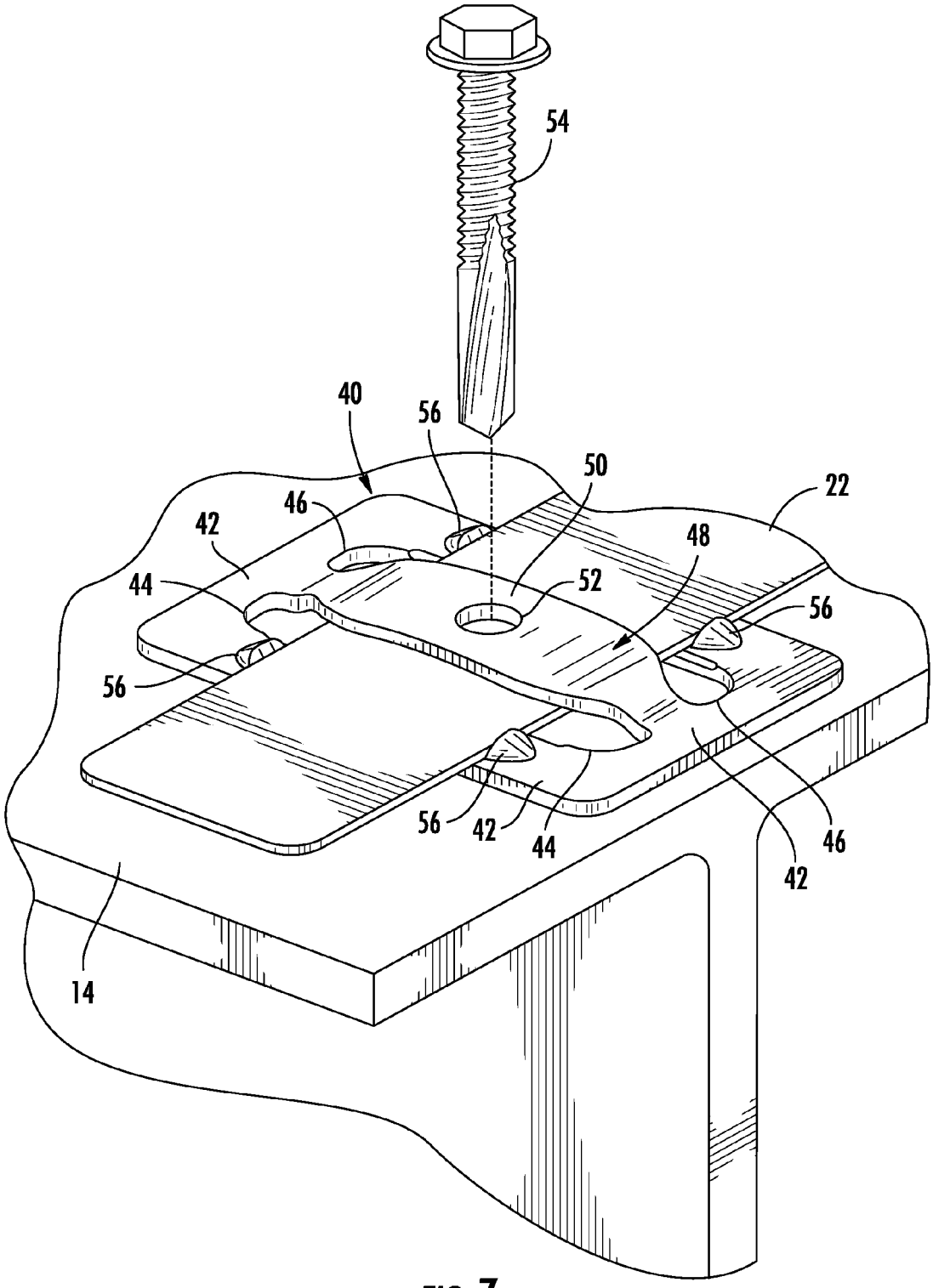
FIG. 7 is a perspective partially-exploded view of a roofing band securable to a roofing beam using a connector according to the present disclosure with one type of fastener.
Figure 8:
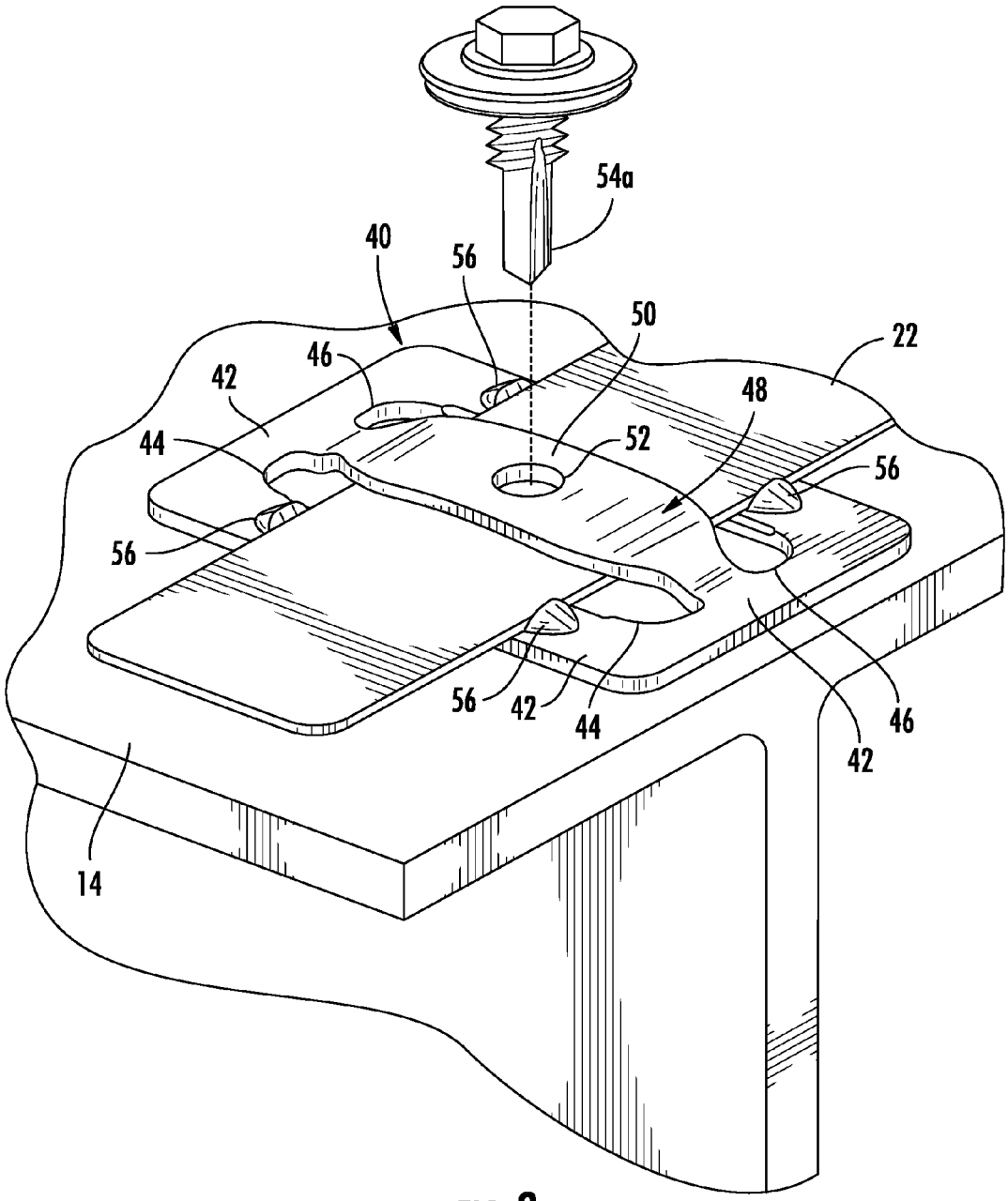
FIG. 8 is a perspective partially-exploded view as in FIG. 7, with an alternate fastener.

A connector 40 is shown in FIG. 5. Connector 40 includes a circumferential outer flange 42 and two recesses 44, 46. Between recesses 44, 46 is a central portion 48 having a middle area 50. As shown, middle area 50 is offset slightly from circumferential outer flange 42 by sufficient distance that a roofing band 22 may be slid through recesses, as shown in FIG. 6. A fastener opening 52 is provided in middle area to receive a threaded fastener, such as a screw 54 (see FIG. 7) or a screw with a washer **54*a* (see FIG. 8**).

If desired, threaded fasteners may be self-drilling fasteners, such as teks screws. Accordingly, fasteners 54 may be #12-24×1¼ inch hex washer head carbon steel plated Tek 5 self-drilling screws, and fasteners **54*a* may be 12-14×¾ inch hex washer head carbon steel plated Tek 3 self-drilling screws, and provided with G90 galvanized bonded washer having an EPDM rubber ¾ inch OD, both available from Rosko Fasteners. Fasteners 54 may be used with connectors 40 at end rafters 14 (see locations in FIG. 2) and fasteners 54*a* may be employed through connectors 40 at struts 16 (see locations in FIG. 3), although other fasteners and arrangements are possible. Also, fasteners with washers such as fasteners 54*a* may be employed throughout the roof in central locations without connectors to secure bands to the underside of purlins 18. If building size or layout requires an overlap (splice) between two bands 22 to span a given area, a connector 40 can be slid over the band further from (above) non-end rafter 14 or (below) purlin 18** at the splice location, sandwiching the other band between the rafter or purlin and the first band with the connector on it, and driving a threaded fastener through all.

If desired, alignment elements 56 may be formed on connector 40. Alignment elements 56 are spaced so as to allow connector 40 to be readily slid onto a band 22 or 24 while maintaining a desired orientation. As shown, four such alignment elements 56 are provided so as to center band 22 within recesses 44 and 46, and so as to center band 22 with reference to fastener opening 52. Therefore, upon driving of threaded fasteners 54, **54*a* through fastener opening, band 22 and into rafter 14, forces and stresses are distributed away from the hole (not shown) in band 22** made by the threaded fastener.

Connector 40 is configured to provide secure mounting of bands 22, 24 to beams within building 10. In particular, connector 40 is useful in mounting ends of bands 22, 24 to beams such as end rafters 14 and struts 16. As compared to previous structures without such connectors or where multiple screws were employed, a stronger connection can be achieved. Applicant believes that such strengthened connection is due at least in part to the larger area of contact all across bands 22, 24 created by connector 40 and threaded fastener 54, **54*a*, as compared to use of a single threaded fastener alone or with a washer, or use of two threaded fasteners with or without washers. Use of threaded fasteners without connectors 40 or washers may concentrate stresses at the threaded fastener/opening interfaces, leading to extension and failing at those points earlier than with the connectors. This can be particularly problematic at end points such as end rafters 14 and struts 16**

Connector 40 may be formed of galvanized, high carbon steel, although other materials could be employed. Connector 40 could be formed by forging, stamping, coining, etc., as desired.

As shown in FIG. 5, connector 40 may be slid over bands 22, 24 and attached at a desired location. Therefore, a connector 40 could be attached to a beam such as an end rafter 14 (FIG. 1) or an end strut 16 (FIG. 2) along the side of building 10. Alternatively, (not shown) a connector may be employed to attach a band to an intermediate rafter 14, strut 16 or purlin 18 in the center or a building. However, typically connectors 40 are used only along the perimeter of a building or building section.

To install a connector 40 on a given beam, one need only slide the given connector over the band 22 or 24 until the connector reaches a desired position. Then, the threaded fastener is driven through the connector 40 via the opening 52, the band 22 and into the beam. If such positions are at side rafters, such attachment can be done on one end prior to feeding of bands across the structure between struts and/or purlins and atop rafters, as is conventionally done. Then, attachment can be made at the other end rafter. If connectors are to be used at some or all other attachment portions along the roof, then additional connectors should be slid onto the particular band, and care should be taken to connect them tightly and in order. However, this is typically not done. Cross bands can be attached by connectors to eave struts 16 on either end, and optionally could be attached to purlins from below where cross points occur. Cross bands can be woven in alternating over/under fashion across the area.

Typically, sheeting 26 would be placed atop bands. Once sheeting 26 is in place, the other layers such as one or more insulation layers 24, 30, outer roofing layers 32, etc., may be attached.

Therefore, by use of such structures, a method of installing a metal roof can be carried out, including the steps of constructing a roof frame of metal beams and attaching a grid of roof bands to the metal beams using threaded fasteners and connectors. It should be understood that the preceding does not mean that connectors must be used at all such threaded fasteners along any given beam, whether it be a perimeter location or central location. The attaching step includes sliding the connector onto the roofing band so that a portion of the roofing band is disposed through first and second recesses in the connector so that a circumferential flange portion of the connector is located on a first side of the roofing band facing the roofing beam and a middle area of a central portion is located on a second side of the roofing band opposite the first side. The attaching step further includes inserting a threaded fastener through the single fastener opening in the connector, the roofing band, and into the roofing beam to fasten the roofing band to a roofing beam. If the location is where sheeting is present, the sheeting may be installed around the fasteners and optionally glued down. Such method may include further sequential attachment of bands at end rafters and eaves until a grid is in place with sheeting on top. At that point, additional steps of adding insulation layers, outer roofing layers etc. can be carried out. Also, attachment to side walls of buildings can also be carried out using the disclosed structure to provide a strengthened structure, although fall prevention is not a concern with side walls.

Use of the above structures and methods provides a reliable, efficient, and simple to install roofing structure. Fall prevention is bolstered by improved fall resistance loading at minimal additional cost without drastic redesign to roofing systems.

These and other modifications and variations to the present disclosure can be practiced by those of ordinary skill in the art, without departing from the spirit and scope of the present disclosure, which is more particularly set forth in the appended claims. In addition, it should be understood that aspects of the various embodiments can be interchanged in whole or in part. Furthermore, those of ordinary skill in the art will appreciate that the foregoing description is by way of example only, and is not intended to limit the disclosure so further described in such appended claims.

What is claimed is:

1. A connector for securing a roofing band to a roofing beam by a threaded fastener, the connector comprising:

a circumferential flange portion;

a first recess extending within the circumferential flange portion;

a second recess extending within the circumferential flange portion substantially parallel to the first recess, the first and second recesses having a length longer than a width of a roofing band;

a central portion extending within the circumferential flange portion between the first recess and the second recess, a middle area of the central portion being offset laterally from the circumferential flange portion by a distance enough to permit the roofing band to be slid through the first and second recesses so that the circumferential flange portion is located on a first side of the roofing band and the middle area of the central portion is located on a second side of the roofing band opposite the first side;

a single fastener opening defined through the central portion, the fastener opening sized for receiving a threaded fastener therethrough for fastening the roofing band to a roofing beam; and four alignment elements located in the circumferential flange portion for aligning the roofing band between sides of the circumferential flange portion and the central portion so that the single fastener opening is centered substantially at a longitudinal center of the band and to center the band within the connector, the four alignment elements being integrally formed with the circumferential flange portion and arranged in parallel pairs on opposite sides of the circumferential flange portion laterally outward of the first and second recesses, with each pair being spaced by an amount substantially equal to the width of the roofing band.

2. The connector of claim 1, wherein an area of contact of the central portion with the band is several times greater than an area of a head of the threaded fastener.

3. The connector of claim 1, wherein first and second recesses are greater than one inch long and the offset between the middle area of the central portion and the circumferential flange is less than about $1/16^{th}$ inch.

4. The connector of claim 1, further including the threaded fastener.

5. The connector of claim 4, wherein the threaded fastener is a metal screw.

6. A metal roof assembly, comprising:

a roofing beam;

a roofing band secured to an underside of the roofing beam;

a connector securing the roofing band to the roofing beam, the connector having a circumferential flange portion, a first recess extending within the circumferential flange portion, a second recess extending within the circumferential flange portion substantially parallel to the first recess, the first and second recesses having a length longer than a width of the roofing band, a central portion extending within the circumferential flange portion between the first recess and the second recess, a middle area of the central portion being offset laterally from the circumferential flange portion, a portion of the roofing band being disposed through the first and second recesses so that the circumferential flange portion is located on a first side of the roofing band facing the roofing beam and the middle area of the central portion is located on a second side of the roofing band opposite the first side, a single fastener opening defined through the central portion;

a threaded fastener extending through the fastener opening, the roofing band, and into the roofing beam to fasten the roofing band to a roofing beam; and four alignment elements located in the circumferential flange portion for aligning the roofing band between sides of the circumferential flange portion and the central portion so that the single fastener opening is centered substantially at a longitudinal center of the band and to center the band within the connector, the four alignment elements being integrally formed with the circumferential flange portion and arranged in parallel pairs on opposite sides of the circumferential flange portion laterally outward of the first and second recesses, with each pair being spaced by an amount substantially equal to the width of the roofing band.

7. The metal roof assembly of claim 6, further including a plurality of the roofing beams, the roofing beams including interconnected rafters, struts, and purlins.

8. The metal roof assembly of claim 7, further including a plurality of the roofing bands, the roofing bands being attached to the roofing beams at various locations.

9. The metal roof assembly of claim 8, wherein the roofing bands are arranged in a grid.

10. The metal roof assembly of claim 9, further including sheeting supported by the roofing beams and the roofing bands.

11. The metal roof assembly of claim 10, further including insulation disposed atop the sheeting.

12. The metal roof assembly of claim 11, further including exterior roofing material disposed atop the roofing beam and insulation.

13. A method for installing a metal roof comprising:

constructing a roof frame of metal beams; and attaching a grid of roof bands to the metal beams using threaded fasteners and connectors, each connector having a circumferential flange portion, a first recess extending within the circumferential flange portion, a second recess extending within the circumferential flange portion substantially parallel to the first recess, the first and second recesses having a length longer than a width of one of the roofing bands, a central portion extending within the circumferential flange portion between the first recess and the second recess, a middle area of the central portion being offset laterally from the circumferential flange portion, the attaching step including sliding the connector onto the roofing band so that a portion of the roofing band is disposed through the first and second recesses so that the circumferential flange portion is located on a first side of the roofing band facing the roofing beam and the middle area of the central portion is located on a second side of the roofing band opposite the first side, a single fastener opening defined through the central portion, the attaching step further including inserting a threaded fastener through the fastener opening, the roofing band, and into the roofing beam to fasten the roofing band to a roofing beam; wherein four alignment elements located in the circumferential flange portion for aligning the roofing band between sides of the circumferential flange portion and the central portion so that the single fastener opening is centered substantially at a longitudinal center of the band and to center the band within the connector, the four alignment elements being integrally formed with the circumferential flange portion and arranged in parallel pairs on opposite sides of the circumferential flange portion laterally outward of the first and second recesses, with each pair being spaced by an amount substantially equal to the width of the roofing band.

14. The method of claim 13, further including installing sheeting atop the grid of roofing bands.

15. The method of claim 14, further including installing insulation atop the sheeting.

16. The method of claim 15, further including installing outer roofing materials atop the metal beams and insulation.

17. The method of claim 13, wherein sliding the connector onto the roofing band includes aligning the band and the connector using alignment elements on the connector.

18. The method of claim 13, wherein inserting of the threaded fastener is accomplished while maintaining alignment of the band and connector using alignment elements on the connector.

* * * * *